United States Patent [19]

Morris

[11] Patent Number: 4,757,622

[45] Date of Patent: Jul. 19, 1988

[54] PORTABLE POWER SHOVEL

[76] Inventor: Charles W. Morris, P.O. Box 66, Paris, Tenn. 38242

[21] Appl. No.: 947,894

[22] Filed: Dec. 30, 1986

[51] Int. Cl.[4] ..... E02F 5/00

[52] U.S. Cl. ..... 37/1; 37/80 R

[58] Field of Search ..... 37/1, 80 R, 103, 118 R, 37/105, DIG. 6, DIG. 11, 130, 137; 299/31, 42, 43, 53

[56] References Cited

U.S. PATENT DOCUMENTS

| | | | |
|---|---|---|---|
| 1,003,028 | 9/1911 | Bowman | 37/105 |
| 1,951,166 | 3/1934 | Protzeller | 37/105 |
| 2,348,796 | 5/1944 | Ferwerda et al. | 37/80 R |
| 3,139,729 | 7/1964 | Miotti | 37/103 |
| 3,298,547 | 1/1967 | Williams | 414/695 |
| 3,375,596 | 4/1968 | Bacquie | 37/118 R |
| 3,964,182 | 6/1976 | Pomeret et al. | 37/1 |
| 4,049,070 | 9/1977. | Soyland | 37/103 |
| 4,612,716 | 9/1986 | Bulgarelli | 37/103 |

FOREIGN PATENT DOCUMENTS

| | | | |
|---|---|---|---|
| 1930939 | 11/1978 | Fed. Rep. of Germany | 37/1 |
| 0159229 | 8/1985 | Japan | 37/118 R |
| 977750 | 12/1964 | United Kingdom | 37/137 |

*Primary Examiner*—Edgar S. Burr
*Assistant Examiner*—Huong Q. Pham
*Attorney, Agent, or Firm*—Sherman and Shalloway

[57] ABSTRACT

The present invention relates to an improved portable power shovel including a shovel portion and a base portion. The shovel portion includes a handle which is to be gripped by the operator, a blade for digging and two hydraulic rams connected to the blade, a first of the rams being provided to reciprocate the blade so that it may dig into a desired area. The second hydraulic ram is connected to the blade so that movements of the second hydraulic ram result in pivoting motions of the blade so that the blade may loosen dirt or other materials at the location where the blade has been inserted through reciprocations of the first mentioned hydraulic ram. The base is connected to the shovel portion and is provided so as to connect the shovel portion with the surrounding walls and ground area so that reciprocations of the first hydraulic ram will have their maximum effect. The base portion may be releasably fixed to the surrounding walls via integral hydraulic rams and may be fixed to the surrounding ground area through the use of removable pins.

15 Claims, 3 Drawing Sheets

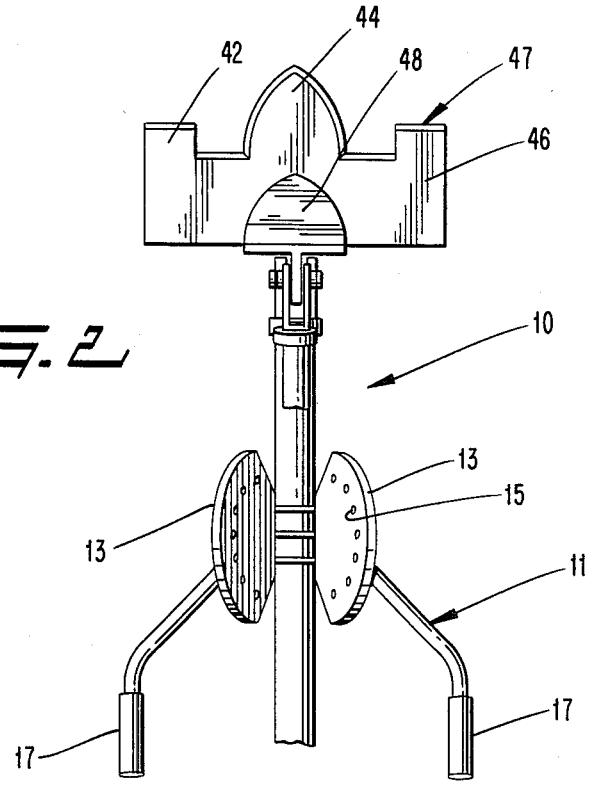
Fig. 2
Fig. 3
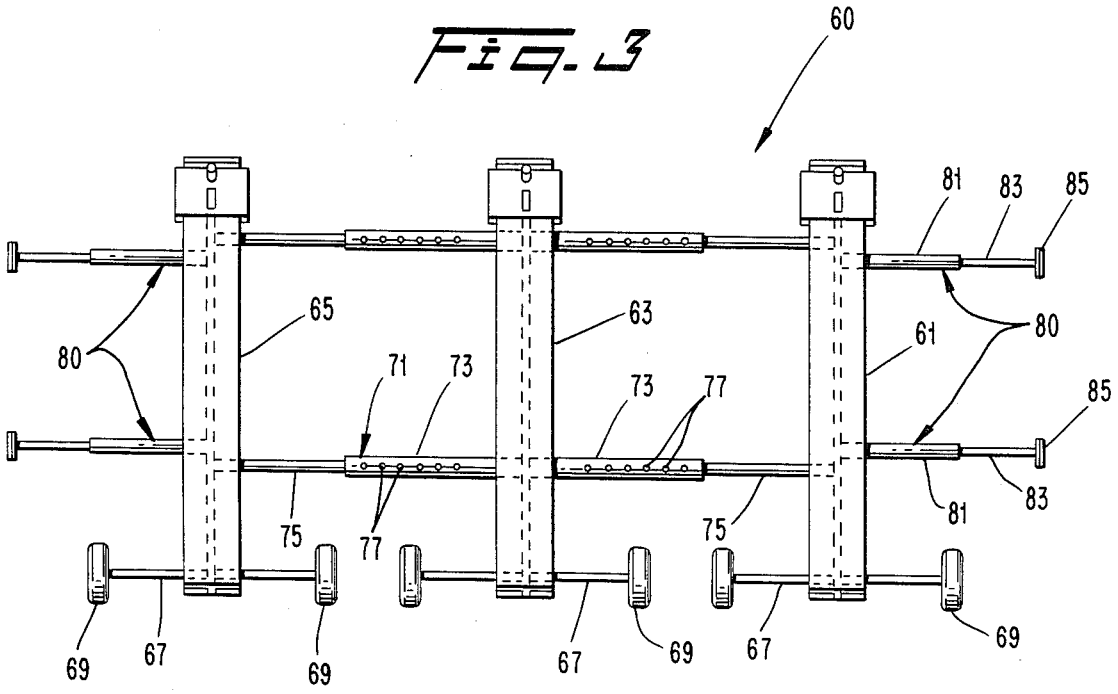

Fig. 4
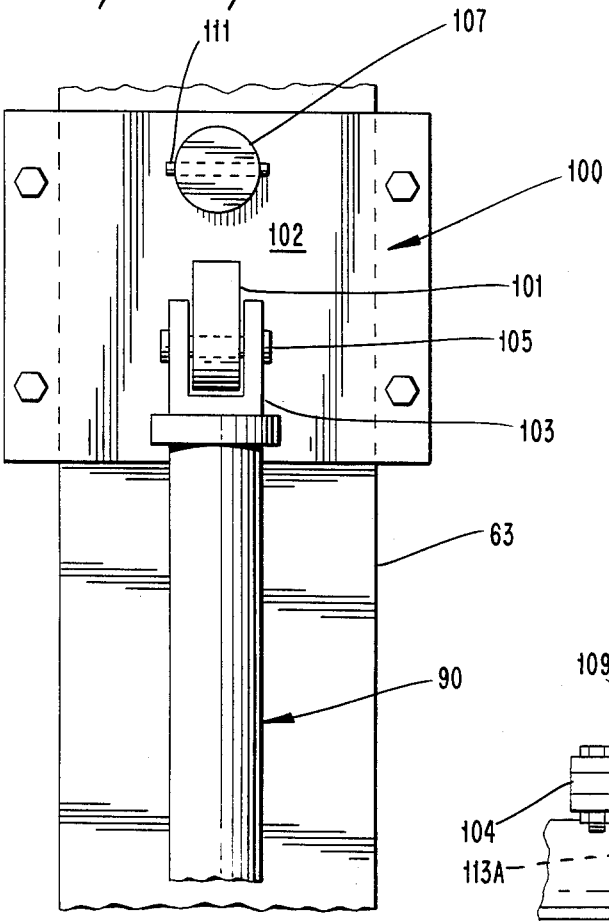
Fig. 5
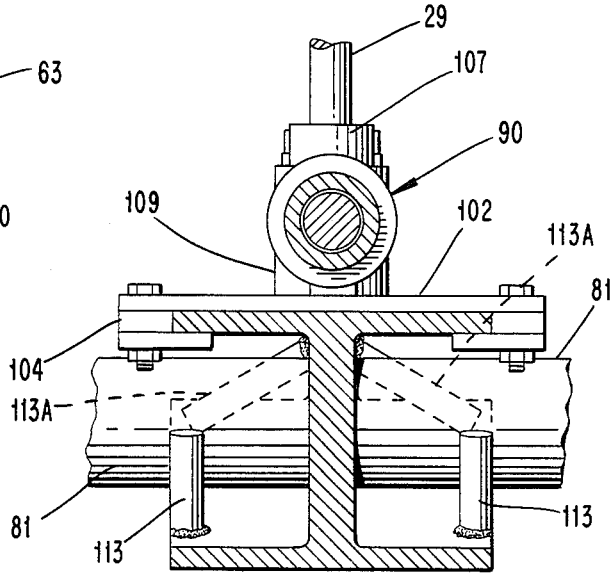
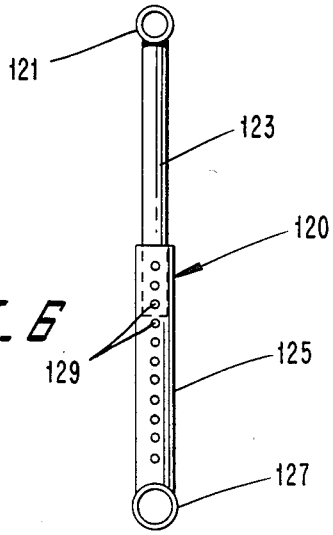
Fig. 6
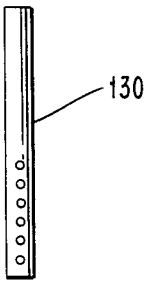
Fig. 7

PORTABLE POWER SHOVEL

BACKGROUND OF THE INVENTION

The present inventon relates to an improved portable power shovel. In the prior art, power shovels are, of course, well known, however, in most cases, power shovels are attached to large, heavy and cumbersome vehicles which may not be used in close quarters with any positive effect since they are not able to be driven to the locaion where digging is required. One example of an environment of use where it is difficult to use a vehicle mounted shovel is in basements where digging is required. Further, the evacuation of catch basins where large spills may occur is not normally possible through the use of a vehicle mounted shovel. Thus, a need has developed for a shovel which is not required to be mounted on a vehicle but which may be stabilized in a fixed position in close quarters and may thereafter be used to dig in an effective manner in such close quarters.

A further location where a vehicle mounted shovel is not practical is in an area where it is desired to dig a tunnel, however, the access location to the beginning of the tunnel is not large enough to accommodate vehicle mounted digging equipment.

The following prior art is known to applicant:

U.S. Pat. No. 3,964,182 to Pomeret, et al. discloses a mechanical shovel which may be operated by a single man and which includes a boom which may be actuated by the user to lift and lower the shovel. While the Pomeret, et al. shovel is clearly portable, this is the sole aspect thereof which may be considered to be in common with the present invention since the Pomeret, et al. device does not have the same actuation means as that of the present invention nor may it be used with the forces applied thereto which may be present with the present invention due to the fact that the present invention may be fixedly secured to its surroundings through the use of the base portion.

U.S. Pat. No. 2,348,796 to Ferwerda, et al. discloses a material moving device including a blade which may be selectively moved toward and away from the ground by a first hydraulic ram device and which may be pivoted upwardly and downwardly through the use of a second hydraulic ram device. Of course, while the actuation of the blade is at least generally related to that of the present invention, Ferwerda, et al. is not portable in the same manner as the present invention is portable and does not include the associated base portion to fixedly secure the shovel portion in position at the location where the digging is required.

U.S. Pat. No. 3,139,199 to Van Auwelaer discloses an earth moving vehicle which may be fixedly located with respect to a ground surface by legs. Similarly, U.S. Pat. No. 3,375,596 to Bacquie discloses an earth moving apparatus having a base described as ground anchorable. The present invention has been specifically devised to overcome the deficiencies of these types of devices since the present invention may be used in locations not accessible to inventions such a those disclosed by Van Auwelaer and Bacquie.

SUMMARY OF THE INVENTION

The present invention overcomes the deficiencies of the above-discussed prior art references and provides an improved portable power shovel which may be used in locations inaccessible to vehicular earth moving equipment and which may be easily moved to different locations within the area where it is to be used and may be seucred in a particular location through the use of the associated base portion. The present invention includes the following interrelated components and aspects:

(a) The present invention includes as its main components a shovel portion and a base portion. The shovel portion includes a shovel head having a blade attached thereto with the shovel head being connected to first and second hydrualic rams. The first hydraulic ram is pivotably connected to a portion of the shovel head adjacent the blade and is also connected at an end thereof remote from its connection to the shovel head to a swivel which is designed to attached the shovel portion to the base portion.

(b) The second hydraulic ram is pivotably connected at one end to the shovel head at a point thereon removed from the location of the blade and at its other end is pivotably connected to a collar which is bolted and tack-welded about the first hydraulic ram.

(c) Thus, when the first hydraulic ram is extended, the shovel head with blade attached thereto is reciprocated. In the preferred embodiment, the piston rod of the second hydraulic ram is connected to the collar, above described, being connected to the cylinder portion of the hydraulic ram so that when the first hydraulic ram is extended, the second hydraulic ram moves with the cylinder portion of the first hydraulic ram. When the second hydraulic ram is retracted, having one end pivotably connected to the first hydraulic ram via the collar and having the second end pivotably connected to the shovel head, such retraction of the second hydraulic ram will cause pivoting of the shovel head about the point of connection between the shovel head and the first hydraulic ram. Thus, actuation of the second hydraulic ram will facilitate the breaking out of material which has been engaged by the blade through extension of the first hydraulic ram.

(d) The above described swivel is connected to a mounting post on the base portion which allows the shovel to be pivoted side to side while maintaining interconnection. The base portion includes a plurality of beams extending parallel to one another with the parallel beams being interconnected via telescoping braces.

(e) The outermost beams have on their respective outside faces additional hydraulic rams with hinged foot pieces which may be extended and retracted as desired so as to wedge the base portion fixedly in the area adjacent to the location where the shovel portion is to be operated. With the combination of the telescoping braces and the adjustable hydraulic rams, the base portion has sufficient adjustability so as to enable it to be fixedly secured in areas of varying sizes and configurations.

(f) To further secure the base portion at any particular location, pins may additionally be employed to vertically secure the base portion in place. In a further aspect, the base portion is also provided with a plurality of wheels and axles which enable it to be easily rolled from location to location during operation. If desired, the axles may have telescoping features compatible with the adjustability of the telescoping braces.

Accordingly, it is a first object of the present invention to provide an improved portable power shovel.

It is a further object of the present invention to provide such an improved portable power shovel having a plurality of hydraulic rams enabling the shovel portion to be reciprocated and the blade itself thereof to be pivoted whenever desired.

It is a still further object of the present invention to provide such a shovel which may be utilized in areas which would be inaccessible to normal excavating equipment.

It is a still further object of the present invention to provide such an improved portable power shovel with a base portion enabling it to be fixedly secured in the area where the work is to be accomplished so that reciprocation of the shovel portion will result in biting of the blade thereof into the material which is to be removed and so that pivoting of the blade through actuation of a hydraulic ram will result in removal of material which is desired to be removed.

These and other objects, aspects and features of the present invention will be better understood from the following detailed description of the preferred embodiments when read in connection with the appended drawing figures.

BRIEF DESCRIPTION OF THE DRAWINGS

FIG. 2 shows a top view of the shovel portion of the present invention.

FIG. 3 shows a top view of the base portion of the present invention.

FIG. 4 shows a top view of the slide plate which is mounted on the base portion of the present invention.

FIG. 5 shows a cross-sectional view along the line 5—5 of FIG. 4.

FIG. 6 shows stabilizer braces which may be used to fix base portion to ground surfaces.

FIG. 7 shows additional bracing to hold base portion up right during digging operations.

SPECIFIC DESCRIPTION OF THE PREFERRED EMBODIMENTS

Figure 1:
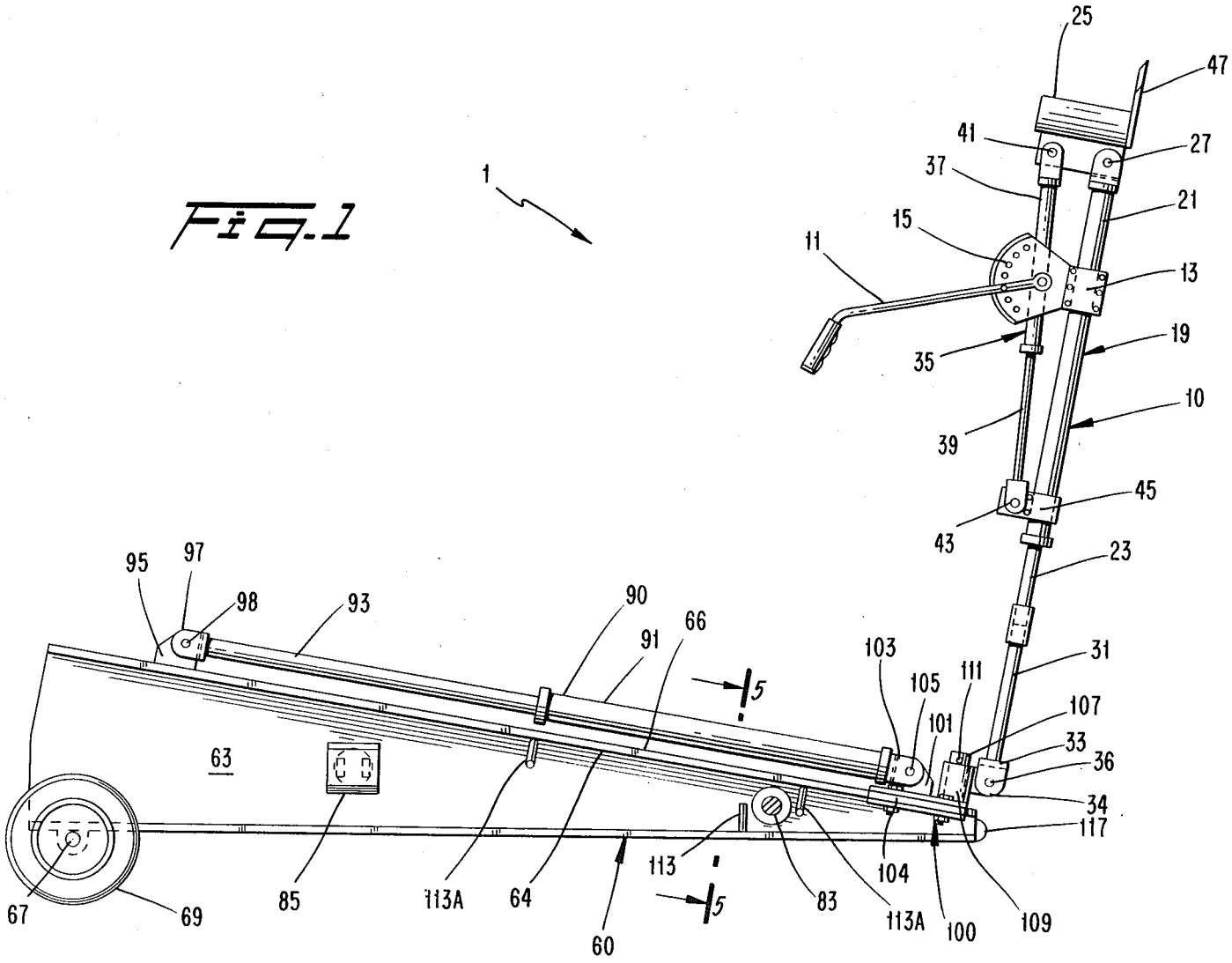
FIG. 1 shows a side view of the present invention.

Reference is first made to FIG. 1 which shows the present invention 1 to include the base portion 60 and the shovel portion 10. With reference to FIG. 1 in conjunction with FIG. 2, the shovel portion 10 is seen to include a pair of handles 11 which are adjustably mounted to respective handle brackets 13 through the use of a plurality of holes 15 in the respective handle brackets 13 through which bolts may be inserted after passing through an opening (not shown) in each handle 11 to thereby rigidly secure each handle 11 in a predetermined angular relationship on the shovel portion 10. Each handle 11 may include a grip 17 comprising, if desired, a rubber sleeve having indentations adapted to be gripped by the fingers of the user so that the user may securely grip the handles 11 in using the shovel portion 10.

The present invention includes adjustment means interconnected between the base portion 60 and the shovel portion 10 provided to adjust the position of the shovel portion 10 with respect to the base portion 60 along an axis of elongation therebetween. With more particular reference being had to FIG. 1, it is seen that the shovel portion 10 includes a first hydraulic ram 19 including a cylinder portion 21 and a piston (not shown) having a piston rod 23 integrally attached thereto and constrained to move therewith. As seen in FIG. 1, the cylinder 21 is attached at its end distal from the piston rod 23 to a shovel head 25 through the use of a pivoting connection 27. The piston rod 23 has connected thereto an extension 29 via a coupling 31 with the extension 29 having, at its end remote from the hydraulic ram 19, a swivel cup 33 which is provded so as to enable the extension 29 to be interconnected in an adjustable fashion with the base portion 60.

With further reference to FIG. 1, a second hydraulic ram 35 is seen to include a cylinder portion 37, a piston (not shown) reciprocable therein and having integrally attached thereto a piston rod 39. The cylinder 37 at its end remote from the piston rod 39 is pivotably connected to the shovel head 25 through a further pivoting connection 41 while the piston rod 39, via a further pivoting connection 43 and a coupling sleeve 45 is bolted and tack-welded to the proximal end of the cylinder 21. As further seen in FIG. 1, the handle brackets 13 are securely bolted to the cylinder 21.

With the shovel portion 10 having been described, its operation will now be explained. As should be understood, the base portion 60, to be described in greater detail hereinafter, is intended to provide a firm support for the shovel portion 10 so that actuations of the hydraulic rams 19 and 35 will have predictable effect. Thus, with the swivel cup 33 securing the shovel portion 10 to the base portion 60, when the piston rod 23 is reciprocated out of the cylinder 21, this will result in elongation of the shovel portion 10 so that the shovel head 25 with its blade 47 may reciprocate and bite into the material which is to be removed. After such reciprocation has taken place, it is then desirable to pivot the blade 47 so that the material into which the blade 47 has been formed may be loosened. For this purpose, the hydraulic ram 35 is activated to reciprocate the piston rod 39 into the cylinder 37 and such movement will cause shortening of the hydraulic ram 35. Since the piston rod 39 is fixed to the cylinder 21 via the connection 43, the cylinder 37 in effect reciprocates with respect to the piston rod 39 to thereby cause the shovel head 25 and, thereby, the blade 47 to pivot about the pivot point 27 on which the cylinder 21 is mounted. This pivoting motion which may be reversed back and forth as desired through actuation of the hydraulic ram 35 will result in pivoting of the blade 47 to thereby loosen the material which is to be removed thereby. After this has been accomplished, the hydraulic ram 19 may be activated to move the piston rod 23 back into the cylinder 21 to thereby shorten the shovel portion 10 to thereby remove the blade 47 from the material in which it had previously been located and so that the shovel portion 10 may be repositioned axially, radially or angularly to a new position where it is to bite into the material.

As best seen in FIG. 2, the blade 47 has a plurality of teeth 42, 44 and 46 which teeth have been specifically designed to best facilitate the biting of the blade 47 into the material. The blade 47 is connected to the shovel head 25 at a reinforced portion 48 for added strength and durability. Of course, the blade 47 may be made of any desired configuration.

The valves which are utilized to activate the hydraulic rams 19 and 35 are not shown in the drawing figures since valves for actuating hydraulic rams are well known in the art and do not form a part of the present invention except insofar as they would be included in the combination of elements which together comprise the present invention. Of course, in activating a hydraulic ram, a two-way valve is provided to connect the ends of a respective cylinder on opposed sides of the piston head with the supply and exhaust of a hydraulic fluid supply system. Thus, when it is desired to reciprocate the piston in one direction, one end of the cylinder is connected to the supply of pressurized fluid and the other end of the cylinder is connected to the exhaust and sump for the pressurized fluid system and application of pressure on the pressurized side will result in reciprocation of the piston and exhaust of fluid on the opposite side to the sump. When it is desired to move the piston in the opposite direction, the connections are merely reversed via the two-way valve so that the side which had previously been connected to exhaust is now connected to the supply side and vice versa so that activation of the pump or other fluid pressure supply means will result in reciprocation of the piston in the opposite direction. If desired, electrical switches may be mounted on one or both handles 11 for each access by the user of shovel portion 10. The switches would activate remotely located valves which would in turn control the hydraulic rams 19 and 35.

Now, reference is made to FIGS. 1, 3, 4 and 5 wherein a specific description of the base portion 60 will be made. Referring to these figures, the base portion 60 is seen to include a plurality of substantially parallel elongated beams 61, 63 and 65 each of which has, at its end remote from the shovel portion 10, an axle 67 and attached to the axle 67 a pair of wheels 69. At least the central beam 63 has an angular, tapered shape as best seen in FIG. 1. If desired, the axles 67 may include structure enabling them to telescope to adjustable lengths so as to allow the user to selectively increase stability by lengthening the axles 67 or, alternatively, to shorten the axles 67 where cramped conditions require such shortening. With particular reference to FIG. 3, it is seen that adjacent ones of the beams 61, 63 and 65 are interconnected through the use of telescoping braces 71 each of which includes a sleeve 73 and a rod 75 slidably inserted in the sleeve 73. Each sleeve 73 includes a plurality of holes 77 therein which may align with holes (not shown) in the respective rods 75 so that pins (not shown) may be inserted through the holes 77 in the sleeves 73 and the holes in the rods 75 so as to lock the telescoping braces 71 in a particular desired length so as to enable the user to selectively choose the distance of separation between the beams 61, 63 and 65 so as to accommodate the base portion 60 to its particular environment of use.

Additionally, the beams 61 and 65 on their sides remote from the central beam 63 also include the provision of a plurality of hydraulic rams 80 each of which includes a cylinder 81, a piston (not shown) slidably mounted within the cylinder 81 and a piston rod 83 connected to the piston and having at its end remote from the piston a foot piece 85 pivotably mounted to the rod 83. The hydraulic rams 80 are provided so that the base portion 60 may be wedged into place wherever the shovel portion 10 is to be used in digging operations. Each of the rams 80 includes individual valve control means (not shown) so that each ram 80 may be individually extended or contracted to accommodate to non-uniform wall surfaces. Regarding the hydraulic rams 19 and 35, specific details were described hereinabove as to the manner of operation of the associated valves (not shown) and these details are equally applicable to the rams 80. In particular, a valve is so connected to each ram 80 that activation of the valve in one direction will cause fluid to be supplied to the respective cylinder 81 to cause the piston rod 83 to be moved outwardly from the cylinder 81 and, whereby, movement of the valve to the other position thereof will cause fluid to be supplied to the cylinder 81 in a manner causing the piston rod 83 to be retracted within the cylinder 81. As is well known to those skilled in the art, the hydraulic rams 80 as well as the hydraulic rams 19 and 35 may be connected to a common supply source, pump and sump for the hydraulic fluid, with such system being designed to have sufficient capacity so that sufficient fluid could be supplied to activate all of the hydraulic rams, 19, 35 and 80 simultaneously.

With further reference, now, to FIG. 1, it is seen that the base portion 60 further includes the provision of adjustment means. The adjustment means includes an additional hydraulic ram 90 including a cylinder 91, piston (not shown) and piston rod 93 slidable within the cylinder 91 in accordance with movements of the piston. As shown in FIG. 1, the piston rod 93 is fixed to the central beam 63 via a brace 95 and a pivot 97 having a pivot pin 98 extending through the pivot 97 (which is attached to the piston rod 93) and through the brace 95. Further, the cylinder 91 is connected, at its end remote from the piston rod 93, to a slide plate 100 via a further brace 101 integrally attached to the slide plate 100 as well as via a pivot 103 connected to the cylinder 91 and through the use of a pin 105 extending through the pivot 103 and the brace 101.

The slide plate 100 has connected thereto a mounting post 107 which is designed to mountingly receive a sleeve 109 forming a part of the swivel cup 33 described hereinabove.

As should be understood from FIG. 1, the sleeve 109 is mounted over the mounting post 107 of the base plate 100 and a pin 111 is inserted through a corresponding opening in the mounting post 107 to thereby secure the sleeve 109 thereon. As should be understood, the sleeve 109 permits rotation of the shovel portion 10 with respect to the mounting post 107 while the pivoted portion of the swivel cup 33 permits up and down pivoting of the shovel portion. As contemplated by applicant, the sleeve 109 will allow rotations of up to 180 degrees total while the pivoted portion of the swivel cup 33 will allow "wristing" movement beyond 90 degrees. FIG. 1 shows the maximum vertical wristing movement of the pivoting portion of the swivel cup 33.

With reference to FIG. 4, the sliding base plate 100 is seen in detail with the mounting post 107, the brace 101, the pivoting portion 103 and the pin 105 being clearly visible. As should be seen with reference to FIGS. 1 and 4, the sliding base plate includes a plate 102 having side walls 104 depending downwardly below the lateral walls 64 of the central beam 63. If desired, for guidance purposes, the side walls 104 may include inwardly extending surfaces designed to engage the undersurfaces of the wall 64 so that the plate 102 is closely guided along the top surface 66 of the wall 64 of the central beam 63.

As further seen in FIG. 1, the central beam 63 may include a plurality of stabilizer pins 113 which are mounted thereon in a fan configuration at differing angles with respect to the axis of the beam 63 and to which may be connected stabilizer braces which may be fixed to the ground surfaces by the use of pins. The pins 113 and 113A are better seen with reference to FIG. 5. With reference now to FIG. 6, a stabilizer 120 is seen to include a first ring 121 fixed to an elongated rod 123 which is slidably mounted within a sleeve 125 having a further ring 127 mounted at an end thereof opposed to the ring 121. The sleeve 125 includes a plurality of holes 129 which are alignable with corresponding holes (not shown) in the rod 123 so that a pin (not shown) may be inserted through a hole 129 of the sleeve 125 and thereafter through a corresponding aligned hole in the rod 123 so as to enable the adjustable fixation of the total length of the stabilizer 120. In order to use the stabilizer 120, one of the rings 121,127 is inserted over one of the stabilizer pins 113 to fixate that end of the stabilizer 120 thereto, and thereafter, the stabilizer is extended to whatever length is desired and the other ring has inserted therethrough a pin to pin the other end of the stabilizer 120 to the ground surface. Such pinning defines the extended length of the stabilizer 120 and in some circumstances, the pins extending through the holes 129 may not be necessary. However, for safety purposes, the use of such pins is strongly recommended.

A second elongated rod 130 as seen in FIG. 7 is used with sleeve 125 which is thereby slipped over pins 113A thereby causing base portion 60 to maintain an upright position when force is applied. Stabilizers used with pins 113A will remain perpendicular to base portion 60.

Of course, the stabilizers 120 are shown as being manually adjustable and lockable through the use of pins. If desired, an alternative device which may be used comprises a hydraulic ram having foot pieces pivotably mounted thereto which may be adjusted through the use of the appropriate valves to a desired length.

As best seen in FIG. 1, a nose cuff 117 may be attached to the end of the central beam 63 to prevent the front of the beam from digging into the ground during relocation of the base portion 60.

Of course, with reference to FIG. 3, while the base portion 60 is shown to include only three beams 61, 63 and 65, if circumstances so require it, additional beams may be incorporaed into the system in such a manner that, for example, an intermediate beam between the beams 61 and 63 would include telescoping braces 71 on each side with only the outer beams 61 and 65 having hydraulic rams on their outer surfaces. Of course, if desired, the telescoping braces 71 may be replaced with hydraulic rams, however, this is not believed to be necessary in view of the large amount of adjustability which is provided through the use of the rams 80.

The present invention having been described in great detail, the method of operating the invention will now be described in great detail.

When the location where digging is to be accomplished is determined, the inventive improved portable power shovel 1 may be transported to the location of proposed digging through the use of any desired means such as a small truck or the like. When the inventive shovel 1 is at the desired location, first, the base portion 60 is positioned adjacent the desired location with the telescoping braces 71 being extended or retracted as necessary to accommodate the base portion 60 to the dimensions and terrain of the area where the digging is to take place. Thereafter, the hydraulic rams 80 are activated so that the piston rods 83 are extended to whatever length is necessary so that the feet 85 firmly engage the adjacent wall surfaces. The feet 85 are pivotably connected to the respective piston rods 83 so that they may adjust to uneven wall surfaces. Further, adjacent hydraulic rams 80 may be activated to extend their respective piston rods 83 differing distances to enable compensation for uneven surface configurations.

If desired, for further stabilization of the base portion 60, stabilizers such as that which is shown in FIG. 6 may be employed for further stabilization. If the use of stabilizers 120 is desired, one of the sleeves 121, 127 thereof is affixed to one of the stabilizer pins 113 whereupon the stabilizer is extender through movement of the sleeve 125 thereof with respect to the rod 123 thereof and thereafter the other of the sleeves 121, 127 is firmly fixed to the ground through the use of a pin (not shown). As explained hereinabove, the position of the rod 123 with respect to the sleeve 125 may be fixed through the use of a pin entering one of the holes 129 and a corresponding hole (not shown) in the piston rod 123.

With the base portion 60 having been firmly fixed in position as explained hereinabove, thereafter, the shovel portion 10 is coupled to the base portion 60 by placing the sleeve 109 of the swivel cup 33 over the mounting post 107 and thereafter releasably securing the sleeve 109 in position through the use of a pin 111. As explained above, the post 109 is integrally connected to the sliding base plate 100 which may be slid to the left or right in the view of FIG. 1 through the application of fluid pressure to the piston (not shown) interconnected with the piston rod 93 which piston is contained within the cylinder 91 of the hydraulic ram 90. Thus, the axial position of the shovel portion 10 with respect to the base portion 60 may be infinitely adjusted through reciprocations of the cylinder 91 with respect to the piston rod 93, which reciprocations, will result in corresponding reciprocations of the sliding base plate 100 and correspondingly the shovel portion 10.

The swivel cup 33, as explained hereinabove, allows side to side movements of the shovel portion 10 through the interaction of the sleeve 109 and the post 107 and further allows vertical pivoting of the shovel portion 10 with respect to the base portion 60 through movements of the pivot portion 34 of the swivel cup including the pin 36.

With the shovel portion 10 coupled to the base portion 60 the shovel portion 10 may be used as follows. With the blade 47 positioned adjacent the material which is to be removed, the control valve for the hydraulic ram 19 may be activated to extend the piston rod 23 thereof out of the cylinder 21 thereof to thereby reciprocate the shovel head 25 and the blade 47 so that the blade 47 enters into the material which is to be removed. This is possible since the base portion 60 firmly fixes the position of the extension rod 29 to provide firm support for movements of the shovel portion 10 and its components with respect thereto.

After the blade 47 has entered the material, it is desirable to pivot the blade 47 to loosen the material which has been impacted by the blade 47. For this purpose, the control valve associated with the hydraulic ram 35 is then activated so as to retract the rod 39 thereof into the cylinder 37 thereof. This motion will cause pivoting of the shovel head 25 with respect to the cylinder 21 to thereby pivot the blade 47 and repeated reversals of the control valve for the hydraulic ram 35 will result in repeated pivoting of the blade 47 to thereby loosen the material adjacent thereto so that it may easily be removed.

After repeated operations of the kind described hereinabove a large portion of the material will have been removed. At this point, it would be advantageous to enable the user to adjust the axial position of the shovel portion 10 with respect to the base portion 60. For this purpose, the hydraulic ram 90 is activated to reciprocate the cylinder 91 thereof with respect to the fixed piston rod 93 thereof. Such activation will result in sliding movements of the sliding base plate 100 and corresponding reciprocation of the shovel portion 10 away from the base portion 60. In this way, the shovel portion may be utilized to remove a large area of material without the necessity of repositioning the base portion 60. After the hydraulic ram 90 has been fully extended and further digging is necessary, at this point, it will be necessary to move the base portion 60 by activating the hydraulic rams 80 so that the feet 85 thereof disengage from the engaged wall surfaces. Thereafter, through the use of the wheels 69, the base portion 60 with the shovel portion 10 attached thereto may be moved to whatever location is desired.

Of course, as different individuals may be using the inventive power shovel 1, the handles 11 thereof are adjustable as explained in great detail hereinabove so that different users will find the shovel portion 10 compatible with their size and strength. In the preferred embodiment of the present invention, the structural components thereof are made of steel components welded together with the welds and material being chosen so that they are able to handle the stresses which are involved when hydraulic forces are utilized to reciprocate machine elements.

Accordingly, an invention has been disclosed in terms of the preferred embodiment thereof which fulfills each and every one of the objects as set forth hereinabove and provides a new improved portable power shovel with great versatility as well as portability and which overcomes all the deficiencies of the prior art discussed. Of course, various changes, alterations and modifications in the teachings of the present invention may be contemplated by those skilled in the art and such changes, alterations and modifications are considered to fall within the purview of the present invention. Accordingly, it is intended that the present invention only be limited by the terms of the appended claims.

What is claimed is:

1. An improved portable power shovel, comprising:

(a) a base portion including at least one beam having an axis of elongation and an angular, tapered shape; and adjustment means carried by said base portion;

(b) a shovel portion including a blade reciprocably and pivotally mounted thereon, said shovel portion including:

(1) a shovel head to which said blade is connected;

(2) a first hydraulic ram having a cylinder connected to said shovel head and a piston in said cylinder having a piston rod connected to said adjustment means; and (3) a second hydraulic ram having a cylinder connected to said shovel head and a piston in said cylinder having a piston rod connected to said first hydraulic ram cylinder;

(4) said blade being extendable by said first hydraulic ram and being pivotable by said second hydraulic ram through a pivoting range of motion including a position generally parallel with said first hydraulic ram; and (c) said adjustment means being interconnected between said base portion and shovel portion for adjusting the position of said shovel portion with respect to said base portion along said axis of elongation.

2. The invention of claim 1, wherein said base portion includes a plurality of wheels, said wheels enabling said base portion to be easily moved and elevating said base portion.

3. The invention of claim 1, wherein said beam has connected thereto at least one stabilizer pin, said power shovel including at least one stabilizer adapted to be interconnected between said stabilizer pin and adjacent ground surfaces to aid in stabilizing said base portion.

4. The invention of claim 1, wherein said base portion includes a further beam adjacent said at least one beam and interconnected thereto by adjustable brace means.

5. The invention of claim 4, wherein said adjustable brace means comprises a plurality of telescoping braces adapted to controllably space said beams apart by a predetermined distance.

6. The invention of claim 5, further wherein one of said beams, on a side thereof remote from said telescoping braces, has attached thereto at least one hydraulic ram means for selective engagement with wall surfaces adjacent to said power shovel for further support of said base portion.

7. The invention of claim 6, wherein said one of said beams comprises said further beam.

8. The invention of claim 1, wherein said shovel portion includes a handle adjustably attached to a handle bracket.

9. The invention of claim 8, wherein said handle brakcet is attached to said first hydraulic ram cylinder.

10. The invention of claim 1, wherein said adjustment means is connected to said shovel portion by a swivel coupling allowing swivelling movements as well as pivoting movements of said shovel portion with respect thereto.

11. The invention of claim 10, wherein said adjustment means comprises a hydraulic ram having a sliding plate connected thereto, said swivel coupling being connected to said sliding plate.

12. The invention of claim 11, wherein said hydraulic ram comprises a cylinder connected to said sliding plate and a piston rod connected to said beam.

13. The invention of claim 12, wherein said sliding plate is slidably mounted on said beam and guided thereby.

14. The invention of claim 11, wherein said sliding plate has a mounting post incorporated therewith, said swivel coupling being releasably connected to said mounting post.

15. The invention of claim 1, wherein said base portion includes at least one foot piece adjustably attached thereto.

* * * * *